US009250571B2

(12) United States Patent
Acquaviva et al.

(10) Patent No.: US 9,250,571 B2
(45) Date of Patent: Feb. 2, 2016

(54) METHOD AND APPARATUS FOR FILLING A TONER CONTAINER USEFUL IN PRINTING

(71) Applicant: XEROX CORPORATION, Norwalk, CT (US)

(72) Inventors: Paul Acquaviva, Fairport, NY (US); Paul M. Wegman, Pittsford, NY (US); Joseph Barbisan, Mississauga (CA); Fumii Higuchi, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 13/797,542

(22) Filed: Mar. 12, 2013

(65) Prior Publication Data

US 2014/0270843 A1 Sep. 18, 2014

(51) Int. Cl.
*B65B 1/22* (2006.01)
*G03G 15/08* (2006.01)

(52) U.S. Cl.
CPC ..... *G03G 15/0894* (2013.01); *B65B 1/22* (2013.01); *G03G 2215/0802* (2013.01)

(58) Field of Classification Search
CPC ..... B65B 1/10; B65B 1/12; B65B 1/22; G03G 2215/0802
USPC ..... 222/226, 236; 366/133
See application file for complete search history.

(56) References Cited

U.S. PATENT DOCUMENTS 5,226,863 A * 7/1993 Kimura ..... 141/8
5,685,348 A * 11/1997 Wegman et al. ..... 141/2
5,727,607 A * 3/1998 Ichikawa et al. ..... 141/67
5,839,485 A * 11/1998 Wegman et al. ..... 141/129
6,000,446 A * 12/1999 Wegman et al. ..... 141/131
6,102,088 A * 8/2000 Wegman ..... 141/286
6,648,029 B1 * 11/2003 Amano ..... 141/59
7,004,210 B1 * 2/2006 Wegman et al. ..... 141/256
7,836,921 B2 * 11/2010 Isomura et al. ..... 141/67
7,980,277 B2 * 7/2011 Amano ..... 141/83
8,069,882 B2 * 12/2011 Combrink ..... 141/74
2002/0127029 A1 * 9/2002 Yamada et al. ..... 399/106
2003/0117892 A1 * 6/2003 Litwiller ..... 366/332
2004/0096242 A1 * 5/2004 Murakami ..... 399/258
2004/0146326 A1 * 7/2004 Ahn et al. ..... 399/358
2005/0238389 A1 * 10/2005 Kim et al. ..... 399/238
2006/0191590 A1 * 8/2006 Wegman ..... 141/65
2007/0140745 A1 * 6/2007 Ono et al. ..... 399/258
2008/0142751 A1 * 6/2008 Wegman ..... 251/306
2010/0080644 A1 * 4/2010 Murase et al. ..... 400/629
2010/0111574 A1 * 5/2010 Ichikawa ..... 399/263
2010/0327020 A1 * 12/2010 Higuchi et al. ..... 222/241
2012/0014713 A1 * 1/2012 Murakami et al. ..... 399/119
2012/0189952 A1 * 7/2012 Lee et al. ..... 430/108.7

* cited by examiner

*Primary Examiner* — Kevin P Shaver
*Assistant Examiner* — Andrew Stclair
(74) *Attorney, Agent, or Firm* — Ronald E. Prass, Jr.; Prass LLP

(57) ABSTRACT

An approach is provided for filling a toner container useful in printing. The approach involves causing, at least in part, a toner container to be coupled to a base member, the base member being configured to contact a lift mechanism. The approach further involves causing, at least in part, the toner container to be moved to a filling position by the lift mechanism. The approach also involves causing, at least in part, a predetermined amount of a toner to be input into the toner container by a filling process when the toner container is in the filling position. The approach additionally involves causing, at least in part, at least the toner inside the toner container to be agitated by way of the base member during the filling process, at least until the toner container is filled with the predetermined amount of toner.

14 Claims, 2 Drawing Sheets

METHOD AND APPARATUS FOR FILLING A TONER CONTAINER USEFUL IN PRINTING

FIELD OF DISCLOSURE

This disclosure relates to an apparatus, method and system for filling a toner container with a predetermined amount of a toner useful in printing.

BACKGROUND

Some image forming devices use powdered toner as the marking material for image forming on image receiving substrates. The term "toner" generally refers to a powder used as the marking material in image forming devices such as xerographic image forming devices, laser printers and photocopiers to form printed text and images on image receiving substrates.

Toner is typically packaged in containers of differing sizes, shapes and compositions. The containers may be generically referred to as "toner cartridges." Toner cartridges are often closed containers in which the toner is conveniently packaged for supply to customers and/or end users. Toner cartridges are customer replaceable consumable components that the customers or end-users install as complete replacement units in image forming devices, which may be opened for access to the toner by an image forming device once the toner cartridge is installed in the image forming device Toner cartridge manufacturers and/or fillers are continually challenged with filling toner cartridges to their maximum capacity. Powdered materials such as toners often experience fluidization making it difficult to fill the toner cartridge to its maximum capacity, or at least to accommodate a predetermined amount of toner material.

SUMMARY

Therefore, there is a need for an approach to fill a toner container with a predetermined amount of a toner useful in printing.

According to one embodiment, a method for filling a toner container useful in printing comprises causing, at least in part, a toner container to be coupled to a base member, the base member being configured to contact a lift mechanism. The method further comprises causing, at least in part, the toner container to be moved to a filling position by the lift mechanism. The method also comprises causing, at least in part, a predetermined amount of a toner to be input into the toner container by a filling process when the toner container is in the filling position. The method additionally comprises causing, at least in part, at least the toner inside the toner container to be agitated by way of the base member during the filling process, at least until the toner container is filled with the predetermined amount of toner.

According to another embodiment, an apparatus for filling a toner container useful in printing comprises at least one processor, and at least one memory including computer program code for one or more computer programs, the at least one memory and the computer program code configured to, with the at least one processor, cause, at least in part, the apparatus to cause, at least in part, a toner container to be coupled to a base member, the base member being configured to contact a lift mechanism. The apparatus is further caused to cause, at least in part, the toner container to be moved to a filling position by the lift mechanism. The apparatus is also caused to cause, at least in part, a predetermined amount of a toner to be input into the toner container by a filling process when the toner container is in the filling position. The apparatus is additionally caused to cause, at least in part, at least the toner inside the toner container to be agitated by way of the base member during the filling process, at least until the toner container is filled with the predetermined amount of toner.

According to another embodiment, a system for filling a toner container useful in printing comprises a base member configured to receive a toner container such that the toner container is coupled to the base member. The system further comprises a lift mechanism configured to contact the base member and cause the toner container to be moved to a filling position. The system also comprises a filling device configured to cause, at least in part, a predetermined amount of a toner to be input into the toner container by a filling process when the toner container is in the filling position. The system additionally comprises an agitation mechanism configured to cause, at least in part, at least the toner inside the container to be agitated by way of the base member during the filling process, at least until the toner container is filled with the predetermined amount of toner.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Examples of a method, apparatus and system for filling a toner container with a predetermined amount of a toner useful in printing are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "toner" generally refers to a powdered material used as the marking material in image forming devices such as xerographic image forming devices, laser printers and photocopiers to form printed text and images on image receiving substrates.

As used herein, the term "toner cartridge" generally refers to a closed container in which toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device.

Figure 1:
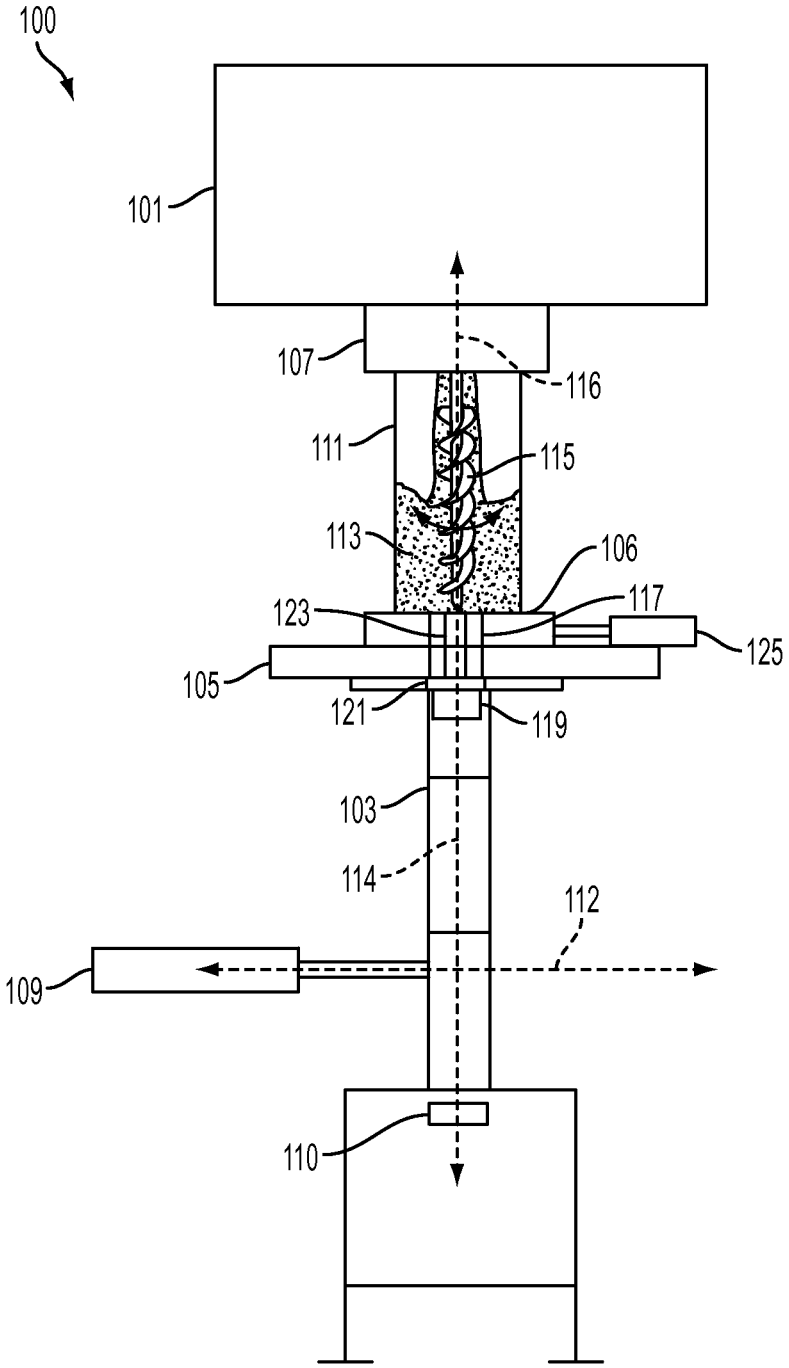
FIG. 1 is a diagram of a system capable of filling a toner container with a predetermined amount of a toner useful in printing, according to one example embodiment.

FIG. 1 is a diagram of a system capable of filling a toner container with a predetermined amount of a toner useful in printing, according to one embodiment. Some image forming devices use a toner such as a toner as the marking material for image forming on image receiving substrates. Toner is typically packaged in containers of differing sizes, shapes and compositions. The containers may be generically referred to as toner cartridges.

Toner cartridge manufacturers and/or fillers are continually challenged with filling toner cartridges to their maximum capacity. Powdered materials such as toners often experience fluidization making it difficult to fill the toner cartridge to its maximum capacity, or at least to accommodate a predetermined amount of toner material. If a toner cartridge is unable to be filled to its maximum capacity, or is unable to be filled with a predetermined amount of toner, the usable life of the toner cartridge may be lower than expected. Such reduction in life expectancy increases waste and operating costs of image forming devices.

Additionally, if a filling device used to fill a toner cartridge with toner is caused to fill a toner cartridge with a predetermined amount of toner, the toner may fluidize and overflow from the toner cartridge despite the toner cartridge being configured to accommodate the predetermined amount of toner. For example, air may be introduced between particles of the toner thereby increasing the expected volume of the predetermined amount of toner. Any overflow of toner during the filling process causes increased manufacturing waste, decreases manufacturing facility cleanliness, causes equipment breakdowns, and ultimately reduces production efficiency.

Some solutions for filling a toner cartridge with a predetermined amount of toner include directly tapping an external surface of the toner cartridge with a movable mechanical member. This direct tapping vibrates the toner cartridge and encourages the toner within the toner cartridge to settle. But, directly applying a vibratory force to an external surface of the toner cartridge with a movable mechanical member often causes the external surface of the toner cartridge to be marred, blemished, or even fractured. In addition to these concerns, some toner cartridges are not shaped in a way that is conducive to accommodating a device configured to mechanically tap an external surface of the toner cartridge.

To address this problem, a system 100 of FIG. 1 introduces the capability to fill a toner container with a predetermined amount of a toner material without directly applying a vibratory force with a movable mechanical member to an external surface of the toner container. FIG. 1 illustrates the toner container in a filling position, as will be discussed in greater detail below. As shown in FIG. 1, the system 100 comprises a filler 101, a lift mechanism 103, a base member 105, a stabilizer 107, and a vibration inducing device 109.

According to various embodiments, the system 100 is configured to accommodate and fill a toner container 111 with a predetermined amount of a toner 113. The toner container 111 is placed on the base member 105 which may allow the toner container 111 to be freely movable on the base member 105, or the base member 105 may be configured to constrain the toner container 111 with a base member coupling 106 alone, or in combination with the stabilizer 107. The stabilizer 107 may, for example, be a filler nozzle associated with the filler 101 or a support member that constrains an end of the toner container 111 other than the end of the toner container 111 that is placed on the base member 105 when the toner container 111 is in a filling position.

The base member 105 is configured to contact a portion of the lift mechanism 103. In some embodiments, the base member 105 may be freely movable with respect to the lift mechanism 103, for example, if the base member 105 is configured to move down a production line with or without a toner container 111 placed on it. In other embodiments, the base member 105 is fixed to a portion of the lift mechanism 103, for example, if toner containers 111 are individually placed on the base member 105 for filling.

Regardless of whether the base member 105 moves down a production line or is fixed to a portion of the lift mechanism 103, the lift mechanism 103 is configured to control a vertical position of the base member 105 when the base member 105 is in contact with the portion of the lift mechanism. Accordingly, the lift mechanism 103 is also configured to control the vertical position of the toner container 111 when the toner container 111 is positioned on the base member 105.

For example, the lift mechanism 103 causes the base member 105 to move between a lowered position and a raised position to facilitate filling of the toner container 111 with a toner 113. The lift mechanism 103, accordingly causes the toner container 111 to be moved from a ready position to a filling position so that the toner 113 can dispensed by the filler 101 during a filling process. The lift mechanism 103 is also configured to lower the base member 105 and the toner container 111 after the filling process is complete so that one or more of the toner container 111 can be removed from its position on the base member 105, or the base member 105 (along with the toner container 111) can be allowed to move down a production line toward a finishing operation.

The filler 101 is configured to dispense a predetermined amount of toner 113 into the toner container 111 during a filling process. The predetermined amount of toner 113 may be any amount based on volume, mass, or weight, for example. If volumetric, the predetermined amount may be based on a determined volume of settled toner, or a determined volume of toner having an acceptable amount of air between some particles of the toner 113. If the predetermined amount of toner 113 is based on mass or weight, that mass or weight can be measured by the filler 101 before dispensing, or by a scale 110 that is used to determine how much toner 113 has been dispensed into the toner container 111 at any time during or after the filling process, for example, based on an initial weight determination of the toner container 111 before the filling process. The filling process is completed when the predetermined amount of toner 113 is one or more of dispensed by the filler 101 or determined to have been received by the toner container 111.

In one or more embodiments, the vibration inducing device 109 is any type of vibratory device or oscillator, such as a piston-type oscillator, configured to cause one or more of the lift mechanism 103 and the base member 105 to be vibrated. The vibration inducing device 109 may be oriented to cause a vibration that is transmitted in any direction. Any vibration caused by the vibration inducing device 109 may be used to indirectly agitate the toner 113 inside the toner container 111. Such indirect agitation encourages the toner 113 to settle, which maximizes the capacity of the toner container 111 and enables the predetermined amount of toner 113 to be accommodated by the toner container 111.

For example, in some embodiments, the vibration inducing device 109 is horizontally mounted to a portion of the lift mechanism 103, or at least mounted to a portion of the system 100 that enables the vibration inducing device 109 to cause the lift mechanism 103 to vibrate. During the filling process, the vibration inducing device 109 causes a vibration at a frequency and amplitude that is transmitted in a direction 112. Direction 112 is horizontal with respect to a vertical line of travel 114 of the toner container 111 as it is moved to the filling position by the lift mechanism 103. This vibration is transmitted through the lift mechanism 103, the base member 105, and accordingly, the toner container 111 to indirectly agitate the toner 113 and encourage settling of the toner 113 so that the predetermined amount of toner 113 can be accommodated by the toner container 111.

According to various embodiments, the vibration inducing device 109 causes the lift mechanism 103 to vibrate at least during the filling process. In some embodiments, the vibration inducing device 109 causes the vibration before and/or after the filling process. For example, continuing the vibration after the filling process until the lift mechanism 103 is in the lowered position may maximize settling of the toner and may reduce the likelihood that any toner may spill and/or puff out of the toner container 111 as the toner container 111 is transferred downstream in a process direction from the system 100. As discussed above, the system 100 may be configured to determine the predetermined amount of toner 113 has been dispensed into the toner container 111 thereby ending the filling process. As such, the system 100 may be configured to stop the vibration inducing device 109 from vibrating the lift mechanism 103 when the filling process is complete.

According to various embodiments, the system 100 may additionally, or alternatively, be configured to directly agitate the toner 113 to encourage settling of the toner 113 during the filling process. For example, the system 100 may be configured to cause a mixer 115 that is internal to the toner container 111 to one or more of move in a first direction during a part of the filling process and in a second direction during another part of the filling process. The mixer 115 may be any of an auger-type mixer, paddle-type mixer, or the like, configured to rotate about an axis of rotation 116.

In this example embodiment, the base member 105 includes the base member coupling 106, discussed above. The base member coupling 106 is outfitted with a receiving port 117. The lift mechanism 103 is configured to include a motor 119 configured to control movement a drive coupling 121. The toner container 111, in this example, further includes a container coupling 123 that is associated with the mixer 115. The container coupling 123 is configured to mate with the receiving port 117. The base member coupling 106, in this example, is configured to facilitate an engagement between the container coupling 123 and the drive coupling 121 so that the motor 119 and the drive coupling 121 may cause the mixer 115 to rotate about its axis of rotation 116. The rotation of the mixer 115 as caused by the motor 119, whether it be in the first direction, second direction, or back and forth in both directions during the filling process directly agitates the toner 113 and encourages settling of the toner during filling process. The motor 119 may be any of a direct current motor caused to change direction by alternating current, or a motor that is capable of changing directions of motion based on a received instruction.

In other example embodiments, the system 100 may additionally or alternatively include mixer-specific vibration inducing device 125 mounted in a position to cause the mixer 115 to be vibrated. Vibrating the mixer 115 would directly agitate the toner 113 and encourage settling of the toner.

Figure 2:
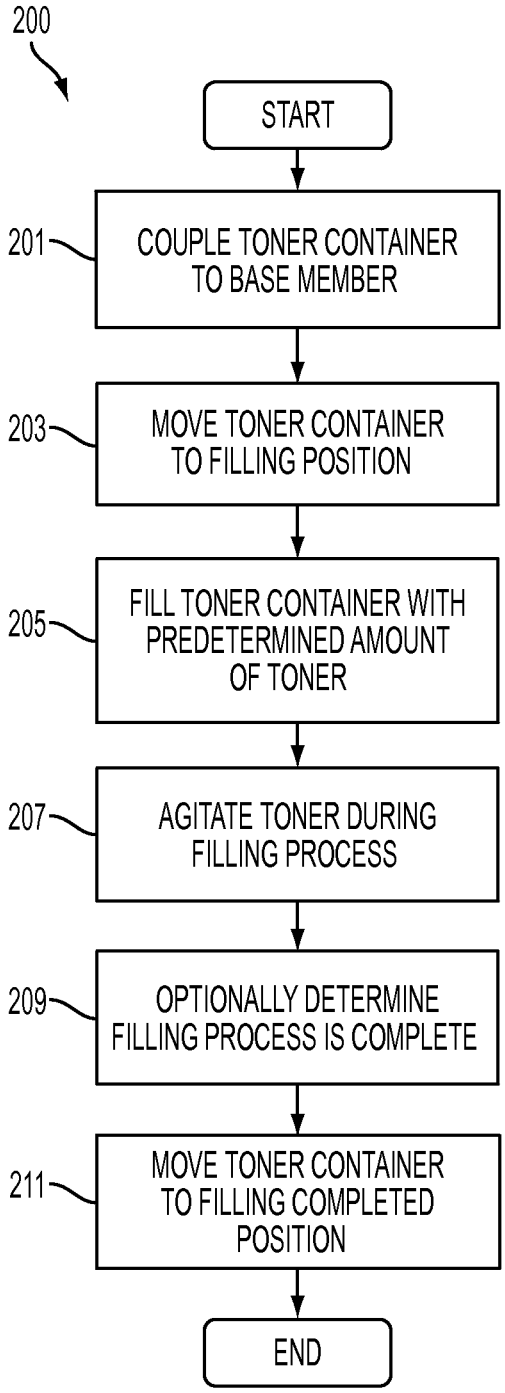
FIG. 2 is a flowchart of a process for filling a toner container with a predetermined amount of a toner useful in printing, according to one example embodiment.

FIG. 2 is a flowchart of a process 200 for filling a toner container with a predetermined amount of a toner material useful in printing, according to one embodiment. In one embodiment, the system 100 performs the process 200 by way of a control module implemented in, for instance, a chip set that includes a processor and a memory. For ease of understanding, the process 200 is discussed with reference to some of the features discussed above, but should in no way be considered to be so limited. In step 201, the system 100 causes, at least in part, a toner container 111 to be coupled to a base member 105, the base member 105 being configured to contact a lift mechanism 103. Next, in step 203, the system 100 causes the lift mechanism 103 to move the toner container to a filling position. Next, in step 205, the system 100 causes, at least in part, a predetermined amount of a toner 113 to be input into the toner container 111 by a filler 101 during a filling process when the toner container is in the filling position.

The process continues to step 207 in which the system 100 causes, at least in part, at least the toner 113 inside the toner container 111 to be agitated by way of the base member 105 during the filling process, at least until the toner container 111 is filled with the predetermined amount of toner 113.

In some embodiments, the agitation is caused by a vibration inducing device 109 that is configured to indirectly agitate the toner 113 inside the toner container 111 during the filling process by way of vibrations transmitted through the lift mechanism 103, the base member 105, and the toner container 111. Alternatively, or in addition to indirectly agitating the toner 113, the toner container 111 may include a mixer 115 that may be rotated or vibrated to directly agitate the toner 113 during the filling process.

Next, in step 209, the system 100 optionally determines the filling process is complete and causes the agitation to stop. Then, in step 211, the system 100 causes the lift mechanism 103 to move the toner container 111 to a filling completed position to facilitate removal of the toner container 111 from the system 100.

The processes described herein for filling a toner container with a toner useful in printing may be advantageously implemented via software, hardware, firmware or a combination of software and/or firmware and/or hardware. For example, the processes described herein, may be advantageously implemented via processor(s), a Digital Signal Processing (DSP) chip, an Application Specific Integrated Circuit (ASIC), Field Programmable Gate Arrays (FPGAs), etc.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can include one or more of dynamic memory (e.g., RAM, magnetic disk, writable optical disk, flash card, etc.) and static memory (e.g., ROM, CD-ROM, etc.) for storing executable instructions or data structures that when executed perform the steps described herein to reduce residual toner in a rotating container.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps discussed above may be executed in any reasonable order to effect the objectives of the disclosed embodiments. No particular order to the disclosed steps of the disclosed method is necessarily implied any discussion or depiction, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

What is claimed is:

1. A method for filling a toner container useful in printing comprising:

causing, at least in part, a toner container to be coupled to a base member, the base member being configured to contact a lift mechanism;

causing, at least in part, the toner container to be moved to a filling position by the lift mechanism;

causing, at least in part, a predetermined amount of a toner to be input into the toner container by a filling process when the toner container is in the filling position;

causing, at least in part, at least the toner inside the toner container to be agitated by way of the base member during the filling process, at least until the toner container is filled with the predetermined amount of toner, the toner being agitated by way of a vibration inducing device external to the toner container, the vibration inducing device configured to vibrate at least the base member during the filling process to indirectly agitate the toner, the toner container including a body section having a mixer therein and a container coupling, the base member coupled to the mixer via engagement between the container coupling and a drive coupling associated with a motor via the base member such that the motor rotates the mixer of the toner container, the base member coupled to the motor and drive coupling associated with the lift mechanism; and causing, at least in part, the toner inside the toner container to be further agitated by way of the mixer, motor and drive coupling associated with the lift mechanism, the vibration inducing device being configured to transmit a vibration through at least the mixer to directly agitate the toner.

2. The method of claim 1, wherein the vibration inducing device is mounted to a portion of the lift mechanism such that the vibration inducing device horizontally vibrates the lift mechanism with respect to a vertical direction of movement of the toner container as caused by the lift mechanism when the toner container is moved to the filling position, the vibration inducing device thereby being configured to indirectly agitate the toner inside the toner container during the filling process by way of vibrations transmitted through at least the lift mechanism and the base member.

3. The method of claim 1, the motor and drive coupling being configured to cause the mixer to rotate in a first direction during a portion of the filling process and a second direction during another portion of the filling process so as to directly agitate the toner during the filling process.

4. The method of claim 3, the vibration inducing device being configured to transmit a vibration through at least the mixer.

5. The method of claim 3, the vibration inducing device being mounted to a portion of the lift mechanism such that the vibration inducing device horizontally vibrates the lift mechanism with respect to a vertical direction of movement of the toner container as caused by the lift mechanism when the toner container is moved to the filling position, the vibration inducing device thereby being configured to indirectly agitate the toner inside the toner container during the filling process by way of vibrations transmitted through at least the lift mechanism and the base member.

6. The method of claim 3, wherein the mixer is an auger.

7. The method of claim 3, wherein the mixer is a paddle.

8. An apparatus for filling a toner container useful in printing comprising:

at least one processor; and at least one memory including computer program code for one or more programs, the at least one memory and the computer program code configured to, with the at least one processor, cause the apparatus to:

cause, at least in part, a toner container to be coupled to a base member, the base member being configured to contact a lift mechanism;

cause, at least in part, the toner container to be moved to a filling position by the lift mechanism;

cause, at least in part, a predetermined amount of a toner to be input into the toner container by a filling process when the toner container is in the filling position;

cause, at least in part, at least the toner inside the toner container to be agitated by way of the base member during the filling process, at least until the toner container is filled with the predetermined amount of toner, the toner being agitated by way of a vibration inducing device external to the toner container, the vibration inducing device configured to vibrate at least the base member during the filling process to indirectly agitate the toner, the toner container including a body section having a mixer therein and a container coupling, the base member coupled to the mixer via engagement between the container coupling and a drive coupling associated with a motor via the base member such that the motor rotates the mixer of the toner container, the base member coupled to the motor and drive coupling associated with the lift mechanism; and cause, at least in part, the toner inside the toner container to be further agitated by way of the mixer, motor and drive coupling associated with the lift mechanism, the vibration inducing device being configured to transmit a vibration through at least the mixer to directly agitate the toner.

9. The apparatus of claim 8, wherein the vibration inducing device is mounted to a portion of the lift mechanism such that the vibration inducing device horizontally vibrates the lift mechanism with respect to a vertical direction of movement of the toner container as caused by the lift mechanism when the toner container is moved to the filling position, the vibration inducing device thereby being configured to indirectly agitate the toner inside the toner container during the filling process by way of vibrations transmitted through at least the lift mechanism and the base member.

10. The apparatus of claim 8, the motor and drive coupling being configured to cause the mixer to rotate in a first direction during a portion of the filling process and a second direction during another portion of the filling process so as to directly agitate the toner during the filling process.

11. The apparatus of claim 10, the vibration inducing device being mounted to a portion of the lift mechanism such that the vibration inducing device horizontally vibrates the lift mechanism with respect to a vertical direction of movement of the toner container as caused by the lift mechanism when the toner container is moved to the filling position, the vibration inducing device thereby being configured to indirectly agitate the toner inside the toner container during the filling process by way of vibrations transmitted through at least the lift mechanism and the base member.

12. The apparatus of claim 10, the oscillator mounted to the lift mechanism such that the oscillator horizontally vibrates the lift mechanism with respect to a vertical direction of movement of the toner container caused by the lift mechanism, the lift mechanism being configured to lift the toner container to facilitate the filling process, the oscillator thereby being configured to indirectly agitate the toner inside the toner container during the filling process by way of vibrations transmitted through the lift mechanism and the base member.

13. A system for filling a toner container useful in printing comprising:

a base member configured to receive a toner container such that the toner container is coupled to the base member;

a lift mechanism configured to contact the base member and cause the toner container to be moved to a filling position;

a filling device configured to cause, at least in part, a predetermined amount of a toner to be input into the toner container by a filling process when the toner container is in the filling position;

an agitation mechanism configured to cause, at least in part, at least the toner inside the container to be agitated by way of the base member during the filling process, at least until the toner container is filled with the predetermined amount of toner, the toner being agitated by way of a vibration inducing device external to the toner container, the vibration inducing device configured to vibrate at least the base member during the filling process to indirectly agitate the toner, the toner container including a body section having a mixer therein and a container coupling, the base member coupled to the mixer via engagement between the container coupling and a drive coupling associated with a motor via the base member such that the motor rotates the mixer of the toner container, the base member coupled to the motor and drive coupling associated with the lift mechanism; and the vibration inducing device causing the toner inside the toner container to be further agitated by way of the mixer, motor and drive coupling associated with the lift mechanism, the vibration inducing device being configured to transmit a vibration through at least the mixer to directly agitate the toner.

14. The system of claim 13, the base member coupling, motor and drive coupling being configured to cause the mixer to move in a first direction during a portion of the filling process and a second direction during another portion of the filling process to directly agitate the toner during the filling process, and the vibration inducing device being configured to transmit a vibration through one or more of the mixer, the base member, and the lift mechanism.

* * * * *